United States Patent [19]

Evans

[11] Patent Number: 5,010,987

[45] Date of Patent: Apr. 30, 1991

[54] GARMENT BAG COVER

[75] Inventor: John Evans, Chesterfield, Mo.

[73] Assignee: Design Research, Inc., Cookeville, Tenn.

[21] Appl. No.: 512,787

[22] Filed: Apr. 20, 1990

[51] Int. Cl.[5] ..... A45C 3/08; A45C 13/30; A45C 13/38

[52] U.S. Cl. ..... 190/26; 150/105; 150/154; 383/111

[58] Field of Search ..... 150/105, 154; 190/26, 190/108, 110; 383/111

[56] References Cited

U.S. PATENT DOCUMENTS

| | | | |
|---|---|---|---|
| 656,707 | 8/1900 | Welshe | 190/26 |
| 796,286 | 8/1905 | Botteese | 190/26 |
| 2,107 180 | 2/1938 | Gihon, 3rd | 190/110 |
| 2,520,250 | 8/1950 | Meyers | 190/26 X |
| 2,617,504 | 11/1952 | Meyers | 190/26 |
| 2,732,046 | 1/1956 | Smallberg | 190/26 |
| 2,839,167 | 6/1958 | Smith | 190/108 |
| 3,901,360 | 8/1975 | Cook | 190/26 |
| 4,244,453 | 1/1981 | Herz | 190/108 X |
| 4,854,431 | 8/1989 | Pulichino, Jr. et al. | 190/110 X |

FOREIGN PATENT DOCUMENTS

| | | | |
|---|---|---|---|
| 7900583 | 8/1979 | PCT Int'l Appl. | 190/108 |
| 1456176 | 11/1976 | United Kingdom | 190/108 |
| 2167656 | 6/1986 | United Kingdom | 190/26 |

*Primary Examiner*—Sue A. Weaver

*Attorney, Agent, or Firm*—John R. Benefiel

[57] ABSTRACT

A cover for a garment bag, comprised of a generally rectangular main section of a durable, flexible sheet material with an up turned border. The main section is adapted to be folded in half after the garment bag is placed within the upturned border, the folded together halves of the main section then being zippered together to enclose the bag. Retainer straps are attached to the bag interior and connected across the middle of the garment bag, and an additional handle retaining strap is secured at one end. A zippered opening extends across the midsection of the cover, enabling garment bag handles to be exposed for extended carrying of the covered bag. External and internal cover pockets are also provided for additional storage.

5 Claims, 2 Drawing Sheets

GARMENT BAG COVER

This invention concerns protective covers for luggage items and more particularly for garment bag type luggage.

Rough handling of baggage is often encountered at airports, when these items are checked with the carrier. Such handling leads to considerable scuffing and wear of the luggage, and there is always a possibility of unintended opening of the luggage and spilling out of the contents. Thus, protective covers for suitcases have previously been devised.

However, heretofore such protective covers have not been devised for garment bags, although such luggage items are likewise subjected to the same wear and tear when checked.

It is also desirable that such a cover contribute to the storage and access convenience of the user.

SUMMARY OF THE INVENTION

The present invention comprises a garment bag cover affording a protective envelop for enclosing a garment bag, which cover is able to be conveniently used and which affords easy access to the garment bag, and also which itself provides additional storage capacity.

The cover comprises an elongated, generally rectangular main section of fabric material sized and shaped to be a little larger than a garment bag, so that a garment bag laid atop the main section lies completely within its perimeter. An upturned border extends about the perimeter of the main section, surrounding a garment bag lying on the main section. A pair of zipper tracks extend about the edge of the border each track occupying a half of the total border lying on either side of the middle of the cover, forming end to end U-shaped track sections, joined to each other at their ends. Zipper sliders at the joined ends of the tracks enable zipping together of the halves of the cover lying against each other when the cover is folded in two at its middle. A pair of retaining straps are fastened at one end to respective border sections at the middle and are adapted to have the free ends connected together over the garment bag when it is positioned on the main cover section to secure the mid section of the garment bag to the inside of the cover.

A releasible loop is mounted at one end of the main section to the inside of the cover adapted to secure a hanger or the upper handle of the garment bag to the inside of the cover.

An externally openable zippered opening extends transversely across the main section at the middle to enable access to handles or carrying straps typically provided on high quality garment bags for convenient carrying of the covered garment bag.

A separable strap is secured on the cover exterior extending transversely across the zippered opening to provide an external grip for incidental lifting of the cover and bag, with the garment bag handles stowed completely within the cover.

The opening also provides convenient access to any exterior pockets on the garment bag.

The interior of the cover is also provided with a large, lined inner pouch, suitable for storing laundry, while the exterior is provided with several closable compartments for added, readily accessible storage capacity.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 2:
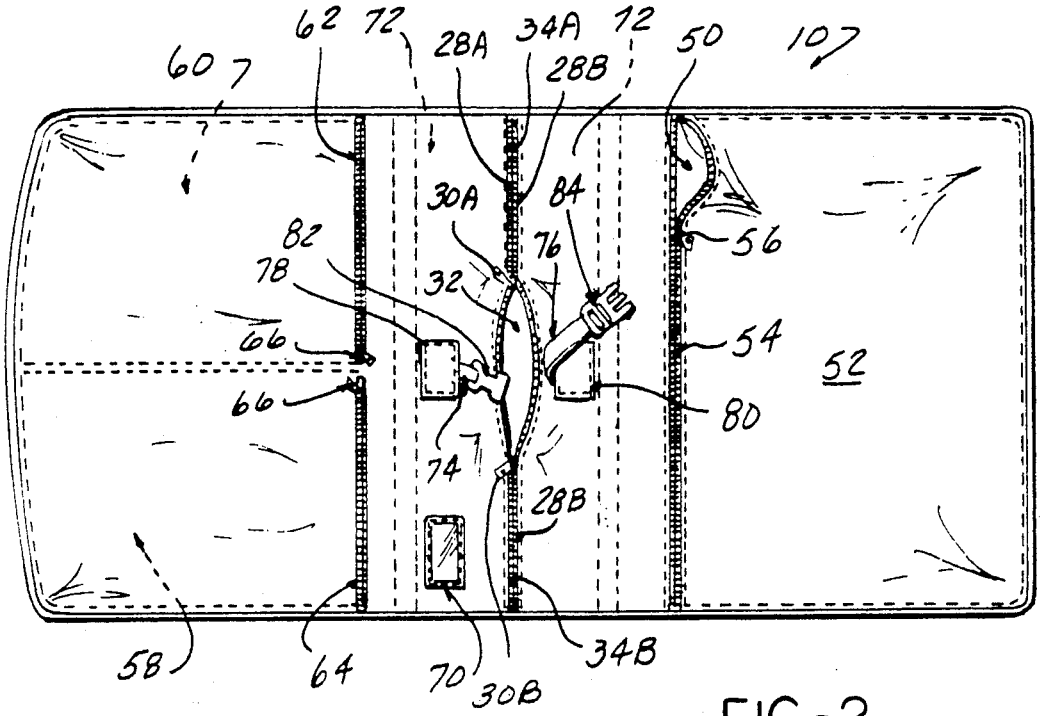
FIG. 2 is a plan, exterior view of the opened garment bag cover from the opposite side as shown in FIG. 1.
Figure 1:
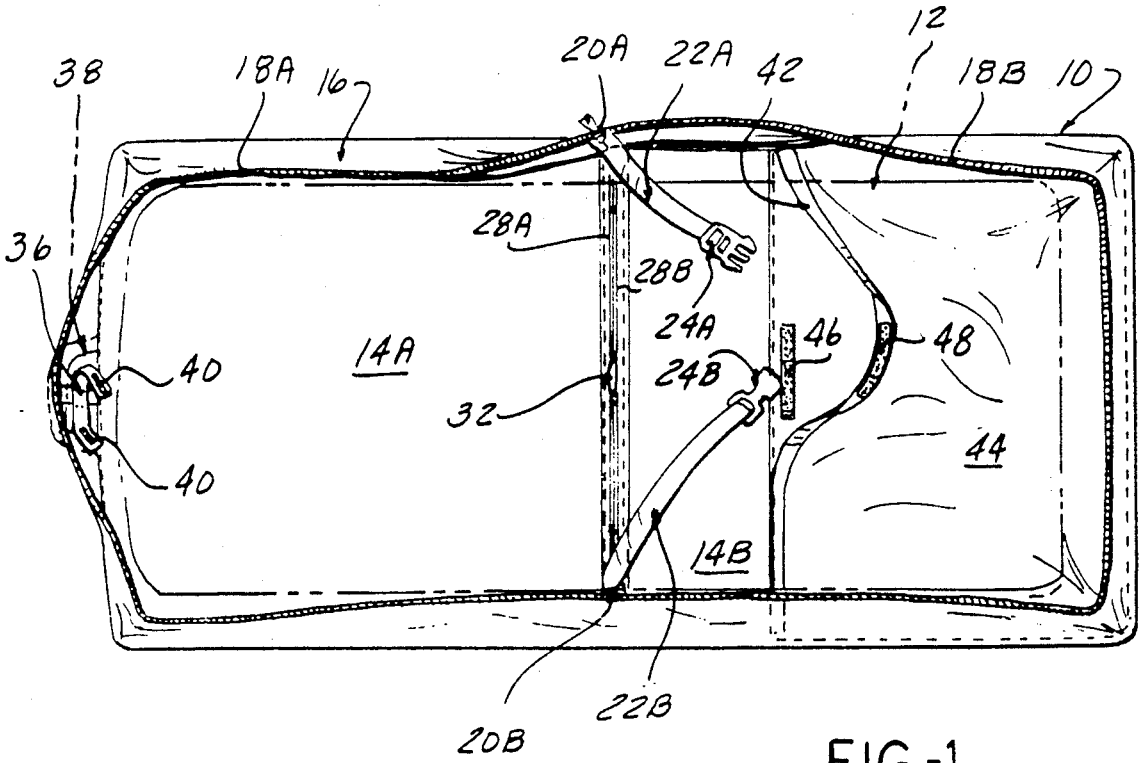
FIG. 1 is a plan, inside view of an opened and laid flat garment bag cover according to the present invention, with the outline of a garment bag indicated in phantom.

Referring to the Drawings, FIG. 1 shows the cover 10 opened and laid flat, so that a garment bag 12, shown in phantom, may be positioned therein. The cover 10 is constructed of a suitable fabric material, such as Nylon (TM), and has a main sheet section 14 of a size and generally rectangular shape to receive the garment bag 12 when laid out flat. The main section 14 is divided into opposite halves 14A, 14B. An upwardly projecting border 16 of fabric material, several inches in depth so as to be able to accomodate the thickness of a fully packed garment bag 12, is attached about the entire perimeter of the main section 14. The border 16 is also of a suitable durable fabric such as Nylon (TM), and may be attached by being sewn to the main section 14 along its entire perimeter.

The upper edge of the border 16 has a pair of zipper tracks 18A, 18B attached to respective halves thereof, forming end-to-end connected U-shaped sections, the ends of which converge together and are connected at the middle of the opened cover 10. Short sections of tape holding the zipper tracks 18A, 18B extend free from the edge of the border 16. Zipper sliders 20A and 20B enable the zipper tracks 18A, 18B to be zipped together upon folding the main section halves 14A, 14B together to generally align the U-shaped track sections with each other. Selective mating retainer straps 22A, 22B are attached at one end to the inside of the border 16 at the midsection, and the ends are able to be connected together over the garment bag 12 by suitable mating connection fittings 24A, 24B each attached to a respective free end of strap 22A or 22B.

Main section halves 14A and 14B each have a zipper track 28A, 28B sewn along the adjacent edges, with zipper sliders 30A, 30B enabling a transverse opening 32 to be formed selectively, of a maximum width determined by sewn in stops 34A, 34B at either side.

Centered at one end of the cover 10, a holder strap 36 is attached on the inside of main section 14A, able to encircle a handle 38 of the garment bag 12, and secured as with mating swatches 40 of Velcro (TM).

An inner pouch 42 is provided created by a sewn in panel 44 closed by swatches of Velcro (TM) 46, 48. Such pouch is lined with a water impervious lining and can thus advantageously be used as a laundry storage, to keep unwashed clothes isolated from the fresh clothing packed elsewhere.

Exterior storage compartments are also provided, a large compartment 50 defined by a large panel 52 sewn to the outside of right end section 14B, a zipper track 54 and slider 56 allowing closure thereof.

Smaller, side-by-side compartments 58, 60 are, on the left side of the cover 10 closed by zipper tracks 62, 64 and sliders 66, 68 respectively.

A business card compartment 70 may also be provided.

Reinforcing panels 72 are stitched to the cover 10 on either side of the midsection.

A pair of straps 74 and 76 are sewn into reinforcing pieces 78, 80, with suitable connector fittings 82, 84 allowing the straps 74, 76, to be connected allowing incidental handling of the cover 10 and enclosed garment bag 12.

In use, the cover 10 is opened by unzipping sliders 20A, 20B and laid flat. The garment bag 12 is then placed on the main sections 14A, 14B, strap 36 is wrapped around the garment bag handle 38 and secured, and intermediate straps 22A, 22B connected over its mid section.

Figure 3:
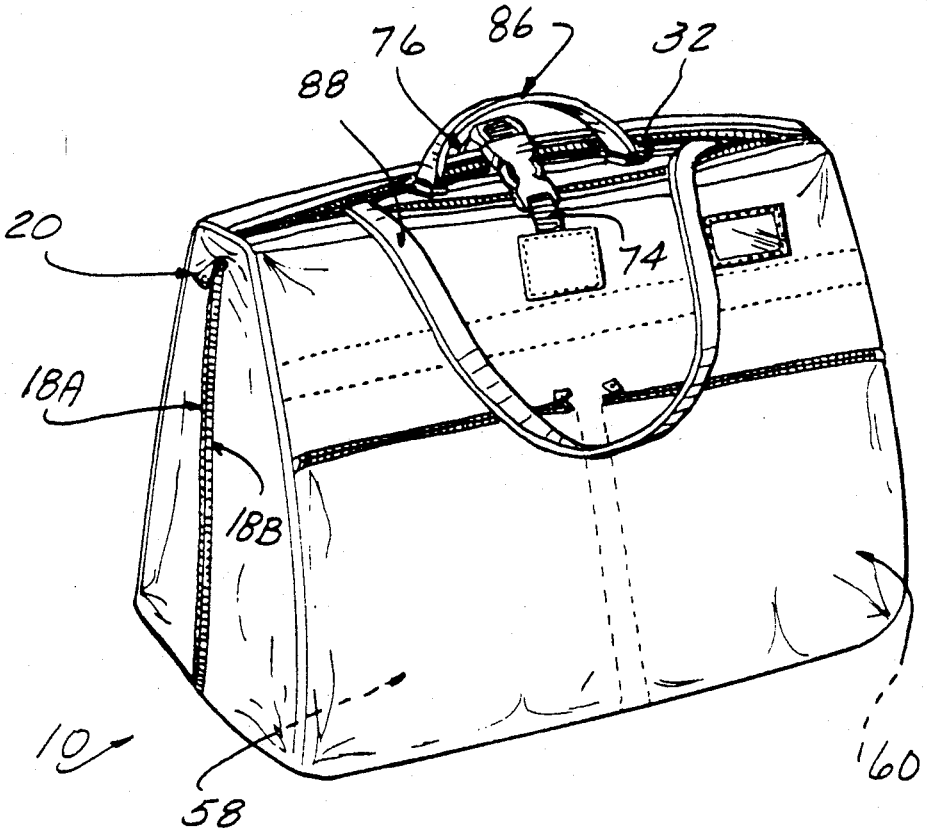
FIG. 3 is a perspective view of the garment bag cover shown in FIGS. 1 and 2, closed over a garment bag and with garment bag handles protruding through a zippered midsection opening.

The cover 10 and garment bag 12 are folded in half, placing main sections 14A, 14B against each other, these sections then zipped together with slider 20A or 20B, 20A shown in FIG. 3.

If the cover 10 and garment bag are being carried, handle 86 and/or strap 88 attached to the middle of the garment bag 12 are pulled out through zippered opening 32 to make extended carrying easier.

When the items are checked, the handle 86 and strap 88 are stowed away within the cover 10, and the opening 32 zippered shut. The connected straps 74, 76 allow incidental handling when the items are being checked.

Thus, the garment bag 12 is completely enclosed and protected when checked.

The top opening 32 also allows easy access to any exterior pockets on the garment bag 12.

Thus, a convenient and effective cover for garment bags has been provided, the cover also useful to the traveler by providing additional storage.

I claim:

1. A cover for a garment bag luggage item comprising:

a generally rectangular main section of flexible material, of a size and shape to allow a garment bag to be laid atop said main section with the bag lying within its perimeter, said main section comprised of a pair of opposite halves lying on either side of the center of said main section;

an upturned border extending around said main section perimeter of a depth corresponding to that of said garment bag, the inside of said border defining a cover interior;

a pair of zipper tracks, each track extending about a respective one half of said border, each track joined to the other at either end at said center of said main section, and at least one zipper slider on one of said joined ends of said tracks, adapted to zipper together said tracks when said tracks are generally aligned with each other with said main section halves folded together;

a pair of straps, each one of said pair of strips connected at one end to a respective side of the interior of said cover at the center of said main section, the other end of each of said pair of straps free, means adapting the other end of each of said straps to be connected to each other to extend said connected straps across said cover;

a zippered opening extending partially across said main section at said center, whereby access to said garment bag through said opening is enabled.

2. The cover according to claim 1 further including a pair of straps, each one of said pair of straps having one end attached to the exterior of said cover on a respective side of said zippered opening and the other end of each of said pair of straps free, and means adapting said respective other ends of each of said pair of straps to be connected together to extend said connected straps across said opening.

3. The cover according to claim 1 further including a strap secured to the inside of one end of said cover at a central location and means for selectively securing said strap when said strap encircles a handle attached to said garment bag.

4. The cover according to claim 1 further including exterior pockets on said cover.

5. The cover according to claim 1 further including an interior pouch sewn into one of said halves of said main section.

* * * * *